US006794962B2

(12) United States Patent
Chambelin et al.

(10) Patent No.: US 6,794,962 B2
(45) Date of Patent: Sep. 21, 2004

(54) CURVED WAVEGUIDE ELEMENT AND TRANSMISSION DEVICE COMPRISING THE SAID ELEMENT

(75) Inventors: Philippe Chambelin, Acigné (FR); Jean-François Pintos, Pacé (FR); Philippe Minard, Rennes (FR)

(73) Assignee: Thomson Licensing S.A., Boulogne-Billancourt (FR)

( * ) Notice: Subject to any disclaimer, the term of this patent is extended or adjusted under 35 U.S.C. 154(b) by 0 days.

(21) Appl. No.: 10/284,840

(22) Filed: Oct. 30, 2002

(65) Prior Publication Data

US 2003/0080828 A1 May 1, 2003

(30) Foreign Application Priority Data

Oct. 30, 2001 (FR) ..... 01 14251

(51) Int. Cl.[7] ..... H01P 1/02
(52) U.S. Cl. ..... 333/249; 333/253
(58) Field of Search ..... 333/248, 249, 333/253, 208

(56) References Cited

U.S. PATENT DOCUMENTS 2,649,578 A * 8/1953 Albersheim ..... 333/249
2,673,962 A * 3/1954 Kock ..... 333/249
2,774,945 A * 12/1956 Miller ..... 333/249
2,810,111 A 10/1957 Cohn ..... 333/249
4,564,826 A * 1/1986 Wiesenfarth et al. ..... 333/249
4,786,913 A * 11/1988 Barendregt et al. ..... 343/765

FOREIGN PATENT DOCUMENTS

FR 2489606 A 3/1982

OTHER PUBLICATIONS

F. Reisdorf: "Die Streumatrix Eines Zweifach Abgeschragten Hohlleitwewinkelstucks" Noz Nachrichtentechnische Zeitschrift, vol. 26, No. 4, Apr. 1973 pp. 176–179, ISSN 0027–707X—translation encl.

French Search Report, Jun. 2002.

* cited by examiner

*Primary Examiner*—Barbara Summons
(74) *Attorney, Agent, or Firm*—Joseph S. Tripoli; Robert D. Shedd; Kuniyuki Akiyama

(57) ABSTRACT

The invention reduces the size of waveguide circuits. The invention proposes to change the cross section of a waveguide in a curved part. Thus, a curved element according to the invention makes it possible at the same time to make a change in waveguide cross action.

8 Claims, 2 Drawing Sheets

CURVED WAVEGUIDE ELEMENT AND TRANSMISSION DEVICE COMPRISING THE SAID ELEMENT

This application claims the benefit under 35 U.S.C. §365 of French patent application No. 0114251 filed Oct. 30, 2001.

BACKGROUND OF THE INVENTION

1. Field of the Invention

The invention relates to a curved waveguide element and to a transmission device comprising the said element.

2. Related Art

Transmission systems use high frequencies of the order of ten gigahertz or more. This is the case with high-rate radio systems such as, for example, transmissions by satellite where the frequency bands are in the region of 10 GHz or at higher frequencies. For these very high frequencies, it is known to use waveguide elements to receive the signals and to effect a first separation of these signals.

FIG. 1 shows the waveguide circuit of a transmitter/receiver device of a known type. The antenna here is a horn 1, for example placed facing a parabolic-type reflector which focuses the reflected waves into a waveguide 2, for example of square cross section. The waveguide 2 itself provides a high-pass filter function which selects the desired bandwidth. A power divider 3 divides the waveguide 2 into two guides of rectangular cross section on which two filters 4 and 5 are placed, these being intended to isolate, on the one hand, the reception frequency band and, on the other hand, the transmission frequency band. Placed at the open end of the filters 4 and 5 are electronic cards, for example produced in microstrip technology, which transpose the signals into an intermediate frequency band in order to transmit an electrical signal to a coaxial cable. To make it easier to produce the device, the electronic cards are placed in the same plane. The filter 4 is a high-pass filter produced simply with the aid of a change in waveguide cross section. The filter 5 is a low-pass filter, for example produced with irises.

Such a device is relatively bulky and requires the use of expensive materials in large quantity. This is because the filter 4 may be relatively long. The change in cross section may be made in several steps, each step having a length equal to at least one quarter of the wavelength associated with the cross section of the guide. In addition, on either side of a change in cross section, the waveguide must have a length equal to the wavelength associated with the cross section of the guide so as to obviate evanescent modes which may be excited in the discontinuities. Thus, the filter 4, although simple and effective, is generally longer than the filter 5, requiring the waveguide supporting the filter 5 to be extended.

SUMMARY OF THE INVENTION

The invention aims to reduce the size of the waveguide circuit. Contrary to the preconceptions of those skilled in the art for whom it is essential to maintain a constant waveguide cross section in the curved parts, the invention proposes to change the cross section in a curved part. Thus, the system consisting of the curved element and of the element having the change in cross section is reduced to the curved element.

The invention is an electromagnetic waveguide element comprising a first wave input/output along a first direction and a second wave input/output along a second direction, the first direction lying within a plane cutting the second direction, the first and second inputs/outputs being connected by at least one curved part. The curved part includes at least one curved portion of constant cross section bounded by two ends, at least one end corresponding to a change in cross section of the guide.

When the two ends of the portion correspond to a change in cross section of the guide, the curved length of the central axis of the waveguide of the portion is equal to an odd multiple of one quarter of the wavelength associated with the cross section of the guide of the portion.

According to a very compact embodiment, the curve of the central axis of the guide has at least one discontinuity at the said end of the portion which corresponds to a change in cross section.

Preferably, the said end corresponding to a change in cross section is located between two curved portions.

The invention is also a transmission device comprising waveguide elements, at least one bent element of which includes a change in cross section of the waveguide at an end of a curved part.

BRIEF DESCRIPTION OF THE DRAWINGS

The invention will be more clearly understood and further features and advantages will become apparent on reading the description which follows, the description referring to the appended drawings, in which.

DESCRIPTION OF THE PREFERRED EMBODIMENTS

Figure 1:
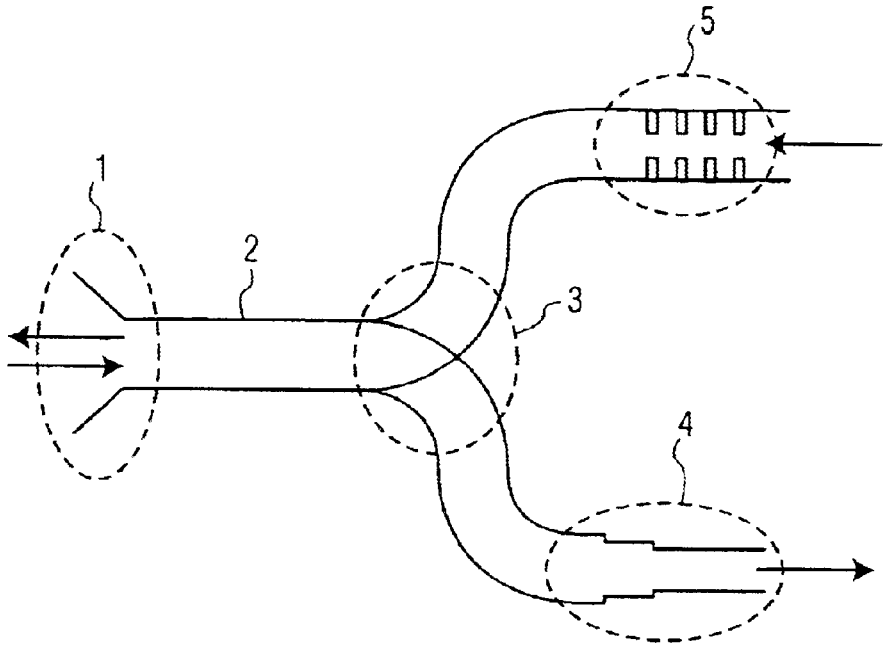
FIG. 1 PRIOR ART
FIG. 1 shows a waveguide circuit of a transmission device according to the prior art.
Figure 2:
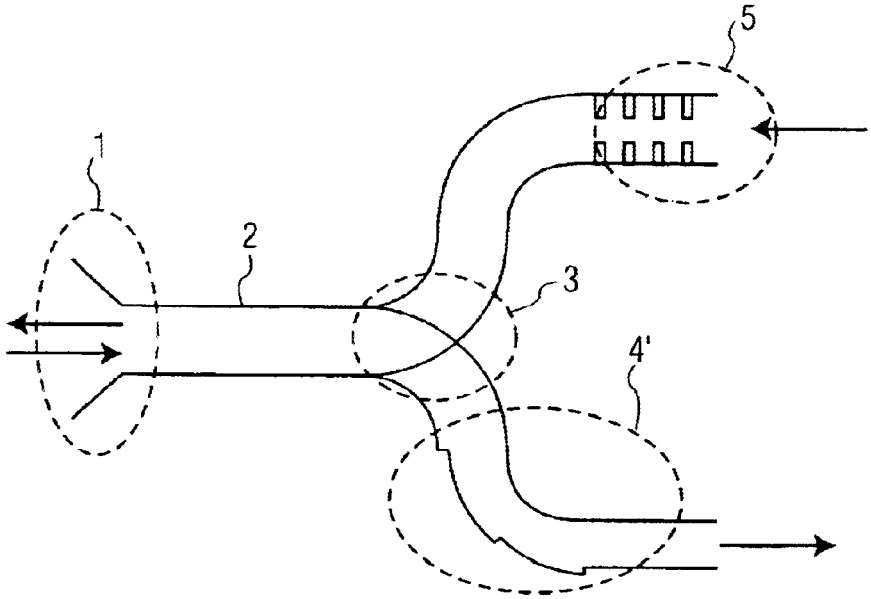
FIG. 2 shows a waveguide circuit of a transmission device according to the invention.

FIG. 2 shows a device equivalent to that of FIG. 1. The circuit in FIG. 2 differs in that the change in cross section of the filter 4' is moved to a curved part of the waveguide. Such a change may seem simple, however several parameters associated with the waveguides must be taken into account.

The change in cross section of a waveguide corresponds to a change in impedance of the waveguide. This change in impedance creates a reflection of the wave, which will perturb the guided wave. To reduce the perturbations due to a significant change in the cross section of the waveguide, it is known to make use of successive changes in cross section. To limit the perturbations due to successive changes, the length of a waveguide located between two changes in cross section must be equal to k times one quarter of the wavelength associated with the cross section of the said guide. However, in a curve, the length of the waveguide is not the same, depending on the position of the wave in the cross section of the waveguide.

Moreover, the propagation of the waves in the curved regions is not homogenous. To avoid any propagation defect, it is known to keep the cross section of the waveguide constant over the entire length of the curve so as to ensure correct propagation.

Figure 3:
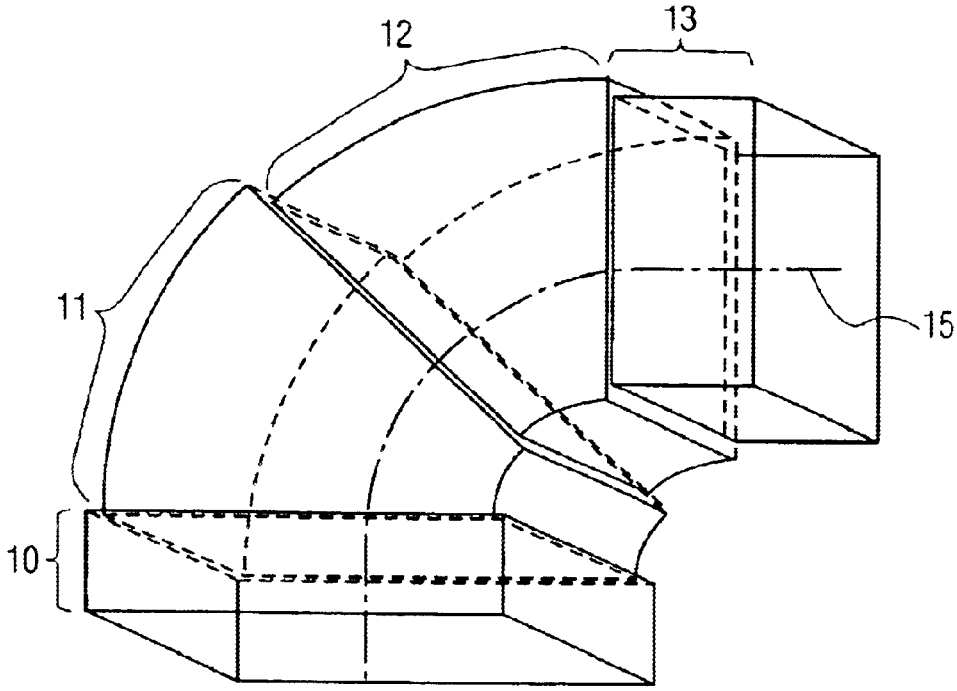
FIGS. 3 and 4 show two embodiments of a waveguide element according to the invention.
Figure 4:
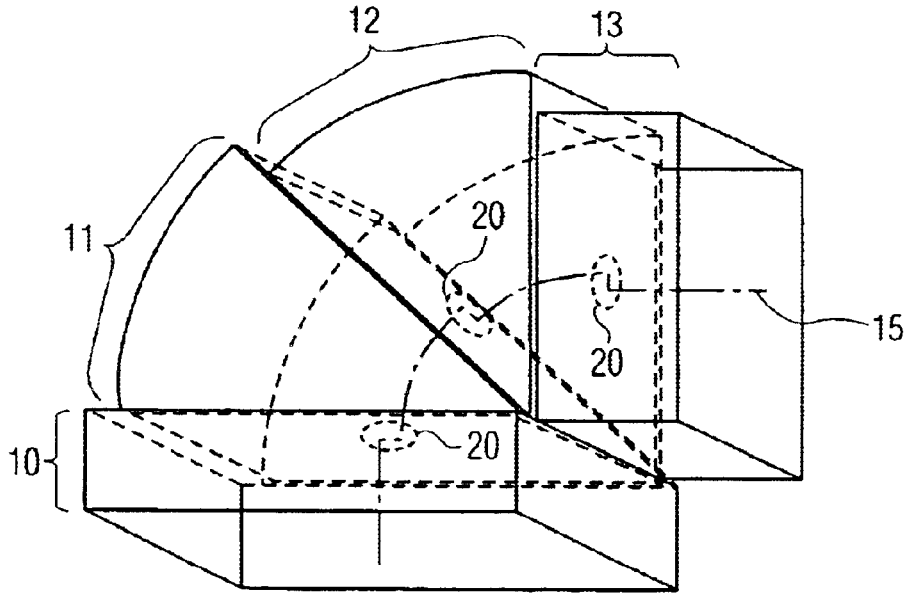

FIGS. 3 and 4 represent particular embodiments of a curved waveguide element according to the invention. For these two embodiments, only the outline of the waveguide has been shown in perspective, the external shape not being shown in order not to clutter up the drawing, as this shape has nothing to do with the invention. These two elements are produced, for example, by welding two half-elements produced by moulding. For both embodiments, three changes in waveguide cross section are used.

The element in FIG. 3 is composed of four waveguide portions 10 to 13. The portions 10 and 13 are straight parts intended to be joined to other waveguide elements. The portions 11 and 12 form a curved part. The curvature of the portions 11 and 12 corresponds to a constant curvature radius. Each waveguide portion 10 to 13 has a constant cross section. The cross sections of each portion are different so as to produce a gradual change in cross section between the cross section of the portion 10 and the cross section of the portion 13. In this example, the ends of each curved portion 11 or 12 correspond to a change in cross section with respect to the adjacent portion. The portions 10 to 13 are centred one with respect to another at the ends. Thus, the axis 15 corresponding to the curve passing through the centre of the waveguide is a continuous curve.

To avoid perturbations due to the change in cross section, the curved portions located between two changes in cross section have dimensions such that the curved length of the axis 15 in the portion is equal to k times one quarter of the wavelength associated with the waveguide cross section of the said portion, k being an odd integer.

FIG. 4 shows an even more compact solution for which the portions 10 to 13 use a common side reduced here to a single edge. The axis 15' corresponding to the curve passing through the centre of the waveguides then has discontinuities 20 at each change in cross section of the waveguide. Such discontinuities do not cause major perturbations, but do allow the size of the curved element to be reduced.

Measurements made on the elements described have shown that perturbations are created in the curved part, but these perturbations become negligible at a point remote from the curved part. The use of a waveguide having a length equal to the wavelength associated with the said waveguide eliminates the perturbations due to the evanescent modes. The result obtained is very similar to the result obtained with a change in cross section over a straight portion.

Very many alternative embodiments of the invention are possible. The number of changes in cross section may vary and depend on the total change in cross section that it is desired to effect. For example, if a single change in cross section is produced, this may be done either at the boundary of a curved portion, or between two curved portions. Again, if only a single change in cross section is produced, it is not necessary to have a curved portion the length of the central axis of which is equal to a multiple of one quarter of the wavelength associated with the cross section of the waveguide of the portion.

For practical construction reasons, the invention produces a waveguide of rectangular cross section with curved parts having a constant curvature radius. A waveguide of circular or elliptical cross section may also be used. It is also possible to have curvature radius that varies continuously in the curved part.

What is claimed is:

1. An electromagnetic waveguide element comprising a first wave input/output along a first direction and a second wave input/output along a second direction, the first direction lying within a plane cutting the second direction, the first and second inputs/outputs being connected by at least one curved part, wherein the curved part includes at least one curved portion of constant cross section bounded by two ends, at least one end corresponding to a change in cross section of the guide and wherein the first input/output has a different cross section than the second input/output.

2. The element according to claim 1, wherein the two ends of the portion correspond to a change in cross section of the guide and in that the curved length of the central axis of the waveguide of the portion is equal to an odd multiple of one quarter of the wavelength associated with the cross section of the guide of the portion.

3. The element according to claim 2, wherein the curve of the central axis of the guide has at least one discontinuity at the said end of the portion which corresponds to a change in cross section.

4. The element according to claim 2, wherein the curve of the central axis of the guide has at least one discontinuity at the said end of the portion which corresponds to a change in cross section.

5. The element according to one of claim 1, wherein the said end corresponding to a change in cross section is located between two curved portions.

6. An electromagnetic waveguide element comprising a first wave input/output along a first direction and a second wave input/output along a second direction, the first direction lying within a plane cutting the second direction, the first and second inputs/outputs being connected by at least one curved part, wherein the curved part includes at least a first curved portion of a first constant cross section bounded by two ends and at least a second curved portion of a second constant cross section bounded by two ends, the second constant cross section being different than the first cross section, and wherein the first curved portion and the second curved portion have a common end corresponding to a change in cross section of the guide.

7. The element according to claim 6, wherein the two ends of the first portion correspond to a change in cross section of the guide and in that the curved length of the central axis of the waveguide of the portion is equal to an odd multiple of one quarter of the wavelength associated with the cross section of the guide of the portion.

8. A transmission device comprising waveguide elements, said device including at least one bent element which includes a change in cross section of the guide between two curved portions of said bent element.

* * * * *